US005226577A

United States Patent [19]

Kohler

[11] Patent Number: 5,226,577

[45] Date of Patent: Jul. 13, 1993

[54] WEB GUIDE FOR ELONGATED FLEXIBLE WEB

[75] Inventor: Herbert B. Kohler, Uniontown, Ohio

[73] Assignee: The Kohler Coating Machinery Corporation, Greentown, Ohio

[21] Appl. No.: 631,338

[22] Filed: Dec. 20, 1990

[51] Int. Cl.[5] ..... B65H 23/32

[52] U.S. Cl. ..... 226/18; 226/21; 226/180; 226/189; 226/197; 226/199

[58] Field of Search ..... 226/3, 15, 18, 21, 22, 226/23, 179, 180, 189, 197, 199

[56] References Cited

U.S. PATENT DOCUMENTS

| | | | |
|---|---|---|---|
| 2,760,773 | 8/1956 | Brodie | 226/199 X |
| 3,017,062 | 1/1962 | Watt et al. | 226/21 X |
| 3,373,288 | 3/1968 | Otepka et al. | 226/21 X |
| 3,682,362 | 8/1972 | Ott, Jr. | 226/21 |
| 3,720,360 | 3/1973 | Tezuka et al. | 226/3 |
| 3,724,732 | 4/1973 | Bonner | 226/21 |
| 3,826,416 | 7/1974 | Takagi et al. | 226/22 |
| 3,966,105 | 6/1976 | Curran | 226/21 |
| 4,342,412 | 8/1982 | Loranz et al. | 226/21 |
| 4,453,659 | 6/1984 | Torpey | 226/21 X |
| 4,760,945 | 8/1988 | Zerle | 226/18 |
| 4,863,087 | 9/1989 | Kohler | 226/13 X |

FOREIGN PATENT DOCUMENTS

| | | | |
|---|---|---|---|
| 3910548 | 4/1990 | Fed. Rep. of Germany | 226/15 |
| 575897 | 3/1946 | United Kingdom | 226/3 |

*Primary Examiner*—Daniel P. Stodola
*Assistant Examiner*—Paul T. Bowen
*Attorney, Agent, or Firm*—Pearne, Gordon, McCoy & Granger

[57] ABSTRACT

An air bar web guide provides lateral adjustment of a running web passing through the guide so that the web exiting the guide is maintained in a constant lateral position. The path length of the web passing through the guide is maintained constant and does not vary from one edge of the web to the other edge. The guide includes a pair of idler rolls journaled for rotation about parallel axes and a pair of air bar guides also maintained parallel to each other. The air bar guides are mounted for pivotal movement with respect to the idler rolls to angulated positions when lateral adjustment of the web is required. A cam system driven by a linkage responsive to the angulated position of the air bar guides moves one of the idler rolls toward and away from the other idler roll to maintain a constant path length of the web passing through the guide system.

8 Claims, 6 Drawing Sheets

WEB GUIDE FOR ELONGATED FLEXIBLE WEB

BACKGROUND OF THE INVENTION

This invention relates generally to an apparatus for guiding flexible web material, and more particularly to a novel and improved compact web guide which provides accurate lateral positioning of a web passing through processing equipment, functions without any change in the length of web path, and maintains uniform tension across the web as the lateral position of the web is adjusted.

PRIOR ART

It is common practice to process various running web materials in long or continuous lengths. The web material may be, for example, paper, smooth or crepe tissue, paperboard, plastic film, woven or nonwoven fabric, fibrous belts or metal foil. Some of these materials may be processed in the same equipment at different times, or even together.

The processing operations may include coating, laminating, saturating, calendering, drying, cooling, curing, and other types of web treatment. Such operations are usually performed in a processing line which consists of a variety of machine elements or processing stations each performing a specific function, and all having a common drive so that the line operates as a unit.

Some of these operations often cause the web to change shape in a manner which affects its tracking. This is particularly true in operations involving wetting and drying or heating and cooling.

It is important that web guide means be provided at various locations in the line to assure accurate alignment of the web as it enters a processing station which performs a specific function, such as coating, laminating, printing, winding or cutting. It is often necessary to guide with a degree of accuracy capable of maintaining the position of the web within a few thousandths of an inch so that material will not be wasted or the web be broken or torn. Further, it is essential that the guiding mechanism not distort the web or change the tension therein in any manner whatsoever. To this end, the adjusting movement of the guide must not change the length of the web path in total, or from edge to edge.

An example of a web guide is illustrated in U.S. Pat. No. 4,863,087, assigned to the assignee of the present invention and incorporated herein by reference.

SUMMARY OF THE INVENTION

There are a number of important aspects of the present invention. In accordance with one aspect, a novel and improved web guide is provided which is compact, and therefore requires less space than most comparable units while still producing a very high accuracy and being capable of large lateral adjustment. The web guide in accordance with the present invention provides lateral adjustment of the position of a flexible running web which does not produce any change in web path length even when substantial adjustment is involved. Further, the web guide functions without producing any variation in the length of the web path across the width of the web.

In the illustrated embodiment, the web guide provides two idler rolls journaled for rotation about parallel and spaced axes in combination with two air bar guides which cooperate to support the flexible web for movement around opposed semicylindrical paths having axes which are also spaced apart and parallel. The idler rolls and the air bars are positioned so that the path of movement or reach as the web moves from one idler roll to one air bar is along a first plane. The path or reach of movement of the web between the air bars is along a second plane parallel to the first plane and the path or reach of movement of the web from the second air bar to the second idler roll is also along a third plane which is parallel to the first and second planes. In the illustrated embodiment, the first and third planes are coplanar.

The air bars and idler rolls are mounted so that the axes of the air bars and the axes of the idler rolls can be angulated relative to each other while the air bar axes remain parallel and the idler roll axes remain parallel. Such relative angulation causes the web moving along the reach between the air bars to be angulated with respect to the reaches between the idler rolls and adjacent or associated air bars. This produces lateral adjustment of the web path. In the illustrated embodiment, the air bars are mounted for movement to angulate them with respect to the idler rolls.

Further, cam means are provided to adjust the spacing between at least one pair of associated axes to maintain a constant path length through the web guide regardless of the lateral adjustment being produced. In the illustrated embodiment, a cam lever is connected to move in response to the magnitude of angulated movement of the air bars and functions to adjust the position of one idler roll with respect to the other idler roll so as to maintain a constant path length through the web guide.

With the illustrated embodiment of the present invention, a compact unit is provided which can be installed in relatively confined locations within a web processing system, which can be mounted either horizontally or vertically, and which can provide plus or minus four inches of correction with no change in tension or web path length through the guide. The correction occurs in-plane only, so there is no skewing or wrinkling of the web and there is absolutely no pass line variation for any amount of correction. The web's lateral tension profile is also independent of the amount of correction, and is unaffected by the operation of the web guide to correct lateral misalignment.

These and other aspects of this invention are illustrated in the accompanying drawings, and are more fully described in the following specification.

DETAILED DESCRIPTION OF THE DRAWINGS

Figure 1:
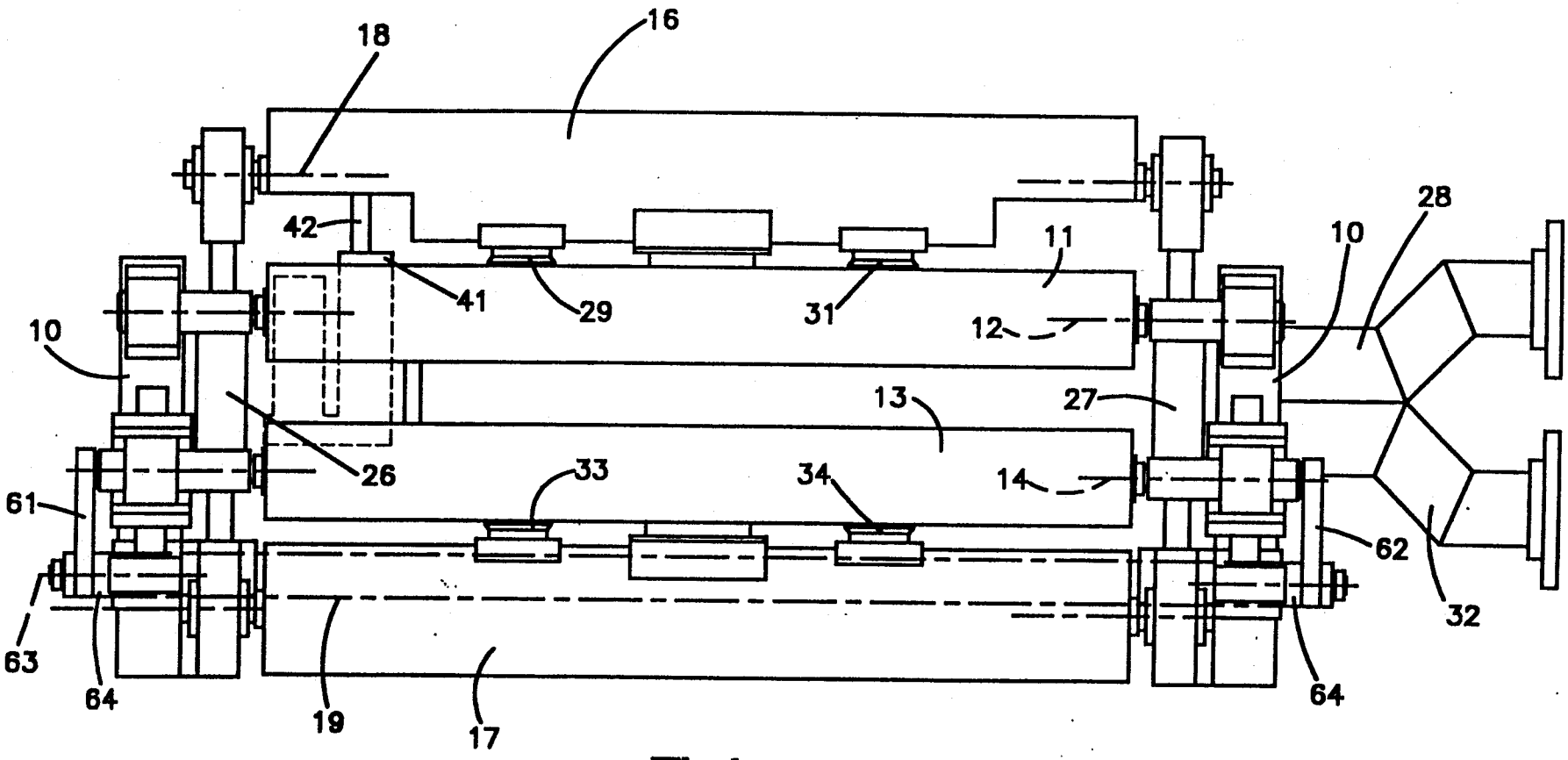
FIG. 1 is a front elevation of a web guide incorporating the present invention, with the lead-in roll removed for purposes of illustration.
Figure 2:
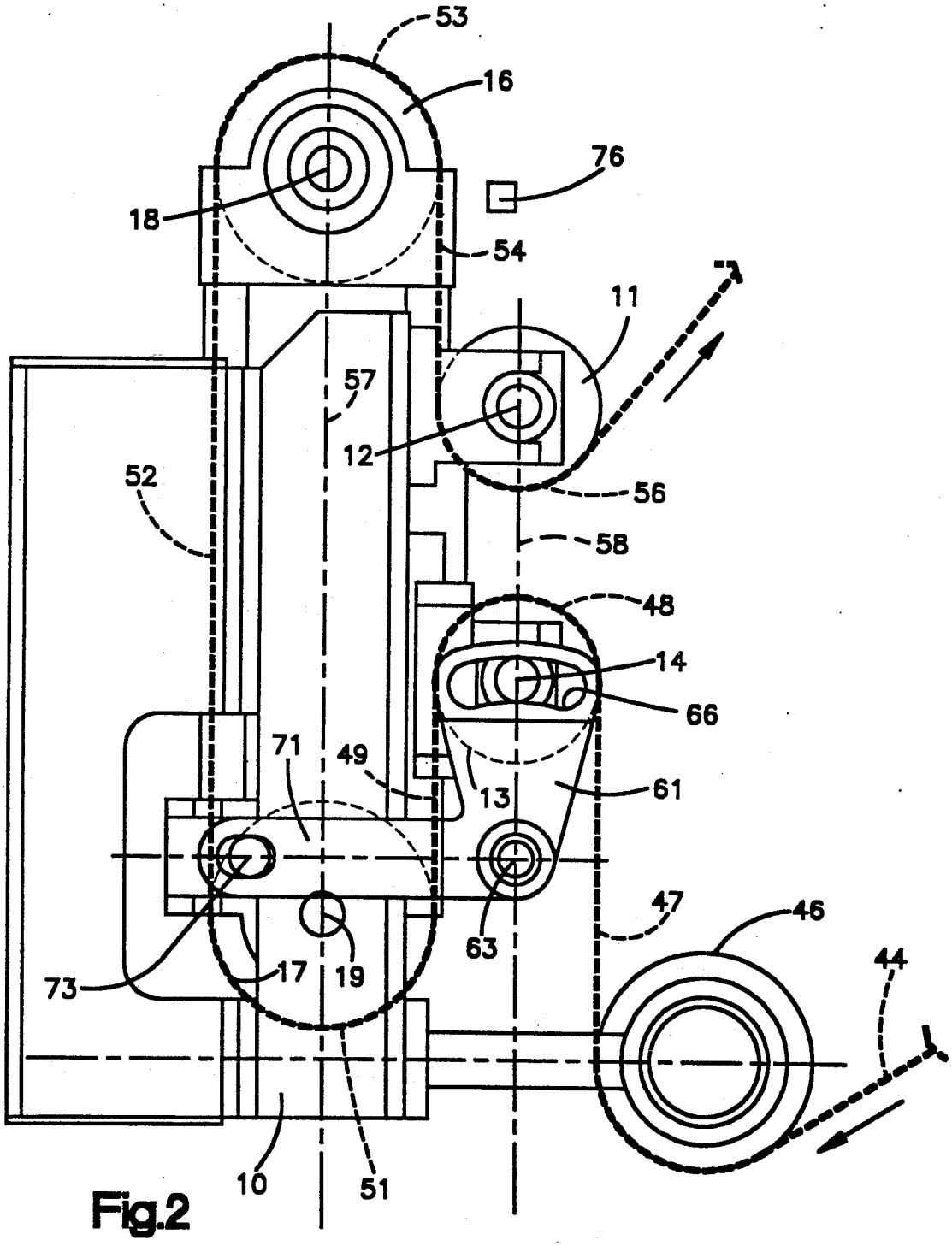
FIG. 2 is an end view of the web guide illustrated in FIG. 1, with the path of the web through the web guide illustrated with a dotted line.

Referring to FIGS. 1 and 2, the web guide includes a frame 10 on which an upper idler roll 11 is journaled for rotation about a pivot axis 12. Mounted directly below the idler roll 11 is a second or lower idler roll 13 journaled on the frame 10 for rotation about an axis 14. As discussed in detail below, a cam system is provided to adjust the axis 14, and in turn the roll 13, toward and away from the axis 12 and the idler roll 11 to maintain a constant path length for the web passing through the machine. The terms "upper" and "lower" or "back," "front," or "horizontal" within this specification are used to conveniently describe the illustrated embodiment but are not intended to be limiting. It should be understood that the machine can be mounted in other than the vertical position illustrated, and will function properly so long as the component relationships discussed below are maintained.

Also mounted on the frame 10 are a pair of opposed air guides 16 and 17. These air guides provide a semicylindrical exterior surface through which extend a plurality of nozzles or orifices sized and positioned to produce a thin layer of air which supports the adjacent web passing around the air bars a small distance away from the surface thereof. Consequently, a web passing around the air bars floats on the thin layer of air and does not physically contact the air bar itself. With such air bars, a frictionless guiding is provided, allowing the web to pass around the air bars in directions which are angulated with respect to the surface of the air bar. The two air bars 16 and 17 provide opposed, semicylindrical surfaces which are surfaces of revolution around the respective axes 18 and 19.

Figure 3:
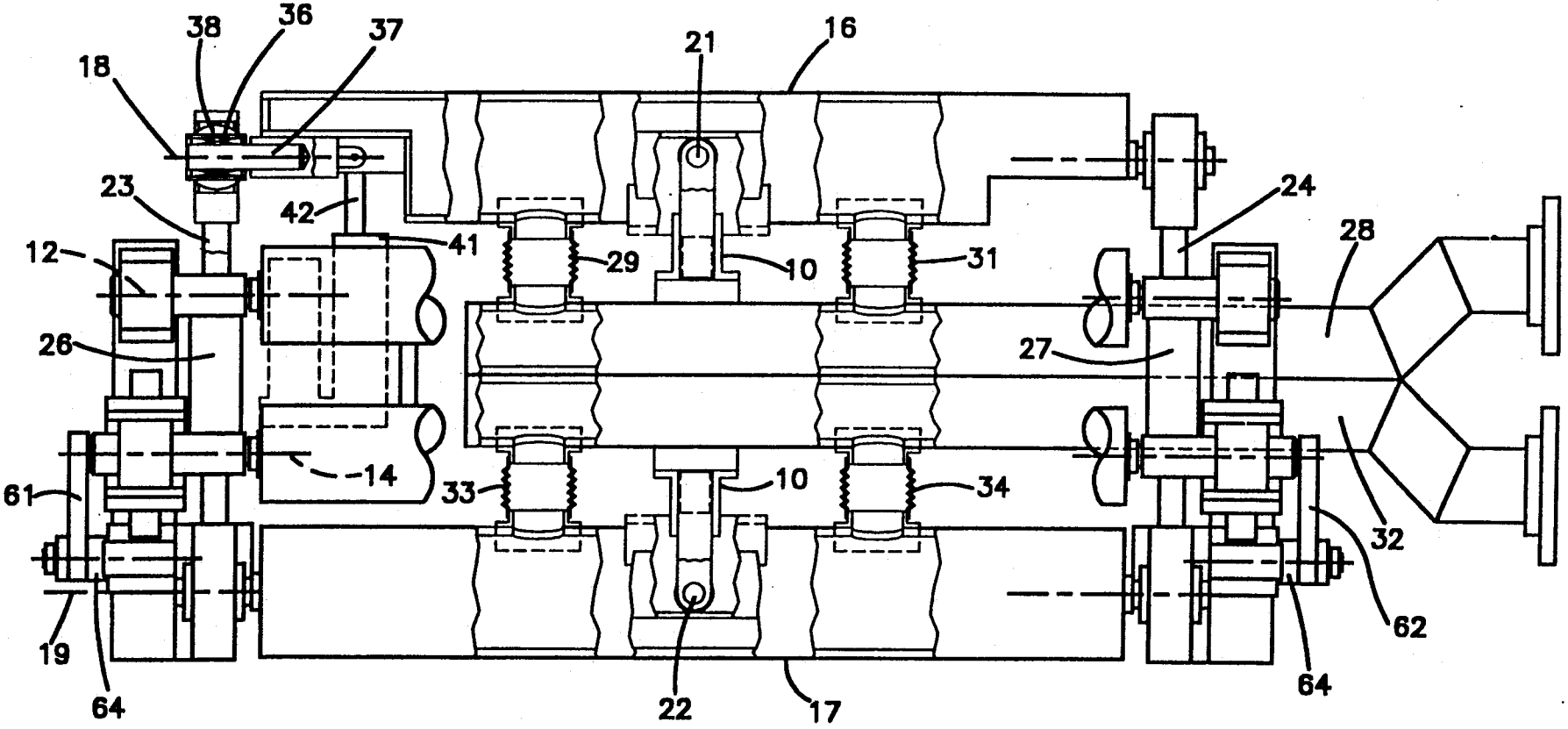
FIG. 3 is a front elevation similar to FIG. 1, but illustrating various parts broken away to better show the mounting and structure of the air bar guide.

Referring to FIG. 3, the upper air bar 16 is mounted on the frame 10 by a pivot 21 which extends perpendicular to a plane containing the two axes 12 and 14 of the idler rolls. The pivot 21 is located midway between the ends of the air bar 16. Similarly, the air bar 17 is journaled on the frame 10 by a pivot 22, which has a pivot axis parallel to the pivot axis of the pivot 21, and also extends perpendicular to a plane containing the axes 12 and 14.

Mounted on each end of the air bars 16 and 17 are connecting rods 23 and 24 which extend through associated linear guide bearing portions 26 and 27 of the frame, and are therefore guided for straight-line, vertical movement within the frame 10. The upper ends of the two connecting rods 23 and 24 are connected to the opposite ends of the upper air bar 16 by a swivel-and slide-bearing system, discussed in greater detail below. The lower ends of the two connecting rods 23 and 24 are similarly connected to the ends of the lower air bar 17. The connecting rods are structured to maintain the two air bars 17 and their respective axes 18 and 19 parallel at all times, while permitting the two air bars to move with pivotal movement about their two pivots 21 and 22 to produce lateral adjustment of a web passing through the web guide.

Air under pressure is supplied through an upper conduit 28 from a source of air pressure (not illustrated) to the upper air bar 16. A pair of flexible boots 29 and 31 connect the conduit 28 to the interior of the air bar 16 at spaced locations along the length of the air bar to ensure that unrestricted flow of the compressed air reaches the interior of the air bar 16 in all positions thereof. Similarly, the lower conduit 32 is connected to the lower air bar 17 through a pair of flexible boots 33 and 34.

Figure 4:
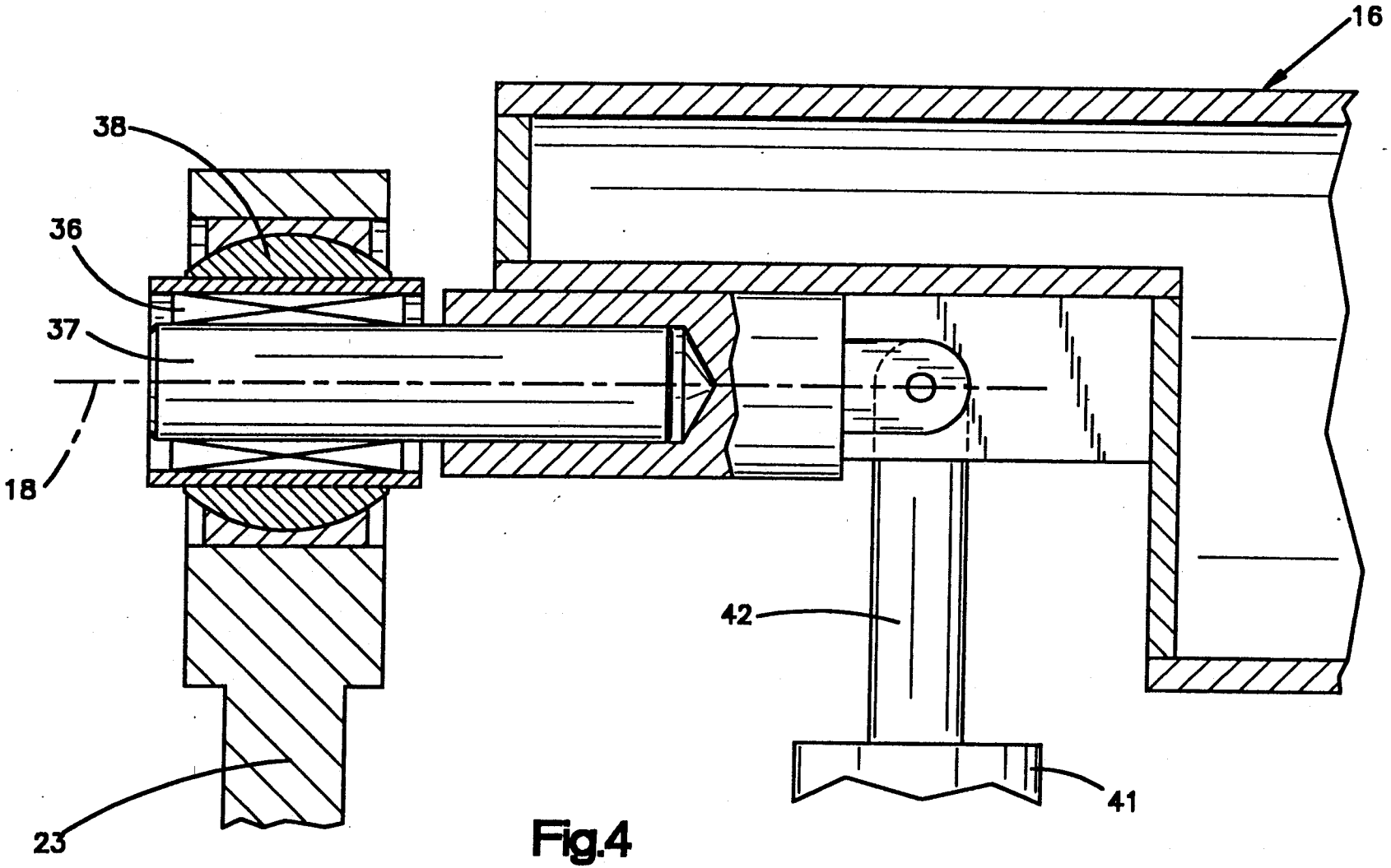
FIG. 4 is an enlarged, fragmentary section illustrating the bearing system at the ends of the air bags which maintain the air bars parallel but allow their movement to angulated positions.
Figure 5:
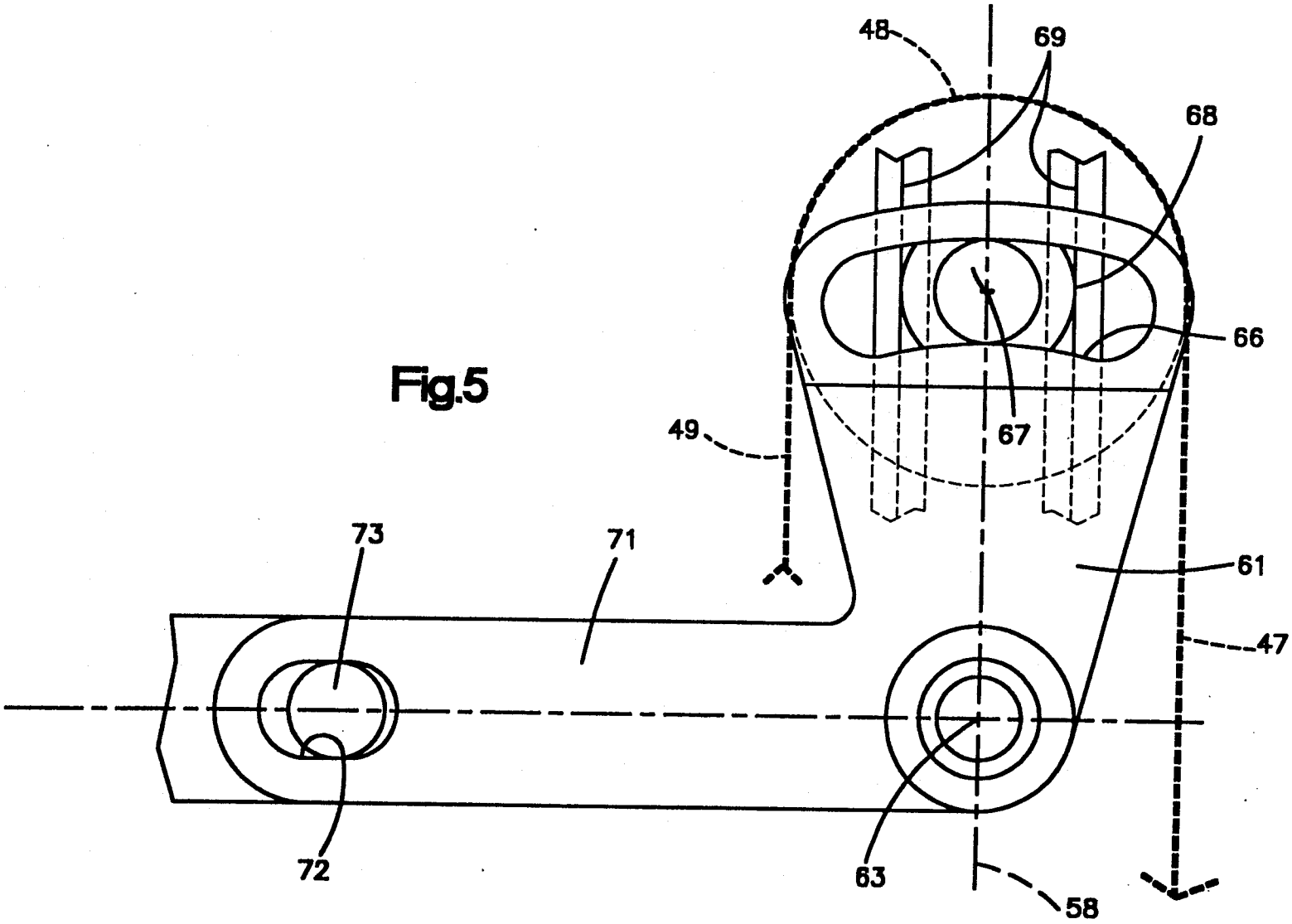
FIG. 5 is a greatly enlarged, fragmentary view of one of the cam links used to adjust the height of one of the idler rolls and thereby maintain a constant path length through the web guide even when substantial lateral adjustments are being provided.

Referring now to FIG. 4, the connection between each of the ends of the connecting rods 23 and 24 and the two air bars 16 and 17 provides a compound bearing including a sleeve bearing 36 which extends around a projecting pin 37 and allows limited relative longitudinal movement between the pin 37 and the sleeve bearing, and in turn limited longitudinal movement of the adjacent end of the connecting rod and the end of the associated of the air bars 16 and 17. Around the sleeve bearing 36 is a swivel bearing 38. With this combined bearing structure, the upward and downward movements of the two connecting rods 23 and 24, which are in a direction restrained by the guide portion 26 and 27 of the frame 10, can occur freely even though the air bars themselves are pivoted about their respective pivots 21 and 22. This structure maintains exact parallelism of the two axes 18 and 19.

A piston-and-cylinder actuator 41 provides a cylinder mounted on the frame 10 and a piston rod 42 connected to the upper air bar 16 to control the angular position of the two air bars. Extension of the piston rod 42 causes the air bar 16 to pivot around its pivot axis 21 in a clockwise direction to angulate the axis 18 with respect to the axes 12 and 14 of the two idler rolls. Conversely, retraction of the piston 42 causes anticlockwise pivotal movement. Because the ends of the air bar 16 are connected to the ends of the air bar 17 by the connecting rods 23 and 24, a similar amount of pivotal movement occurs in the air bar 17 about its pivot 22, and the axes 18 and 19 remain parallel.

Referring now to FIG. 2, a web 44 illustrated by dotted lines passes over an entry roll 46 and extends along a first reach 47 from the entrance roll up to the lower idler roll 13. The web then extends around the idler roll 13 through a 180-degree wrap angle 48 to a second reach 49, which extends along a plane parallel to the plane of the first reach 47. The web then extends around the lower air bar 17 through a second 180-degree wrap angle 51 to a third reach 52. The third reach 52 extends along a plane parallel to the reach 49 to the upper air bar 16, around which the web then passes through another 180-degree wrap angle 53 to a fourth reach 54. From the fourth reach, which extends between the upper air bar 16 and the upper idler roll 11, the web passes around the upper idler roll 11 through a wrap angle 56, which in the illustrated embodiment is less than 180 degrees. Here again, the fourth reach 54 extends along a plane which is parallel to the reaches 47, 49, and 52, and in the illustrated embodiment is coplanar with the reach 49.

As best illustrated in FIG. 2, the axes 18 and 19 are contained in a plane 47 which is parallel to a plane 58 containing the two axes 12 and 14. Here again, these relationships are preferred, and are achieved when the radii of the air bars 16 and 17 are equal and the diameters of the two idler rolls 11 and 13 are equal.

Mounted at each end of the idler roll 13 is a cam lever 61 and 62. These cam levers are journaled in the frame 10 for pivotal movement about a pivot axis 63 and are connected by a torque tube 64 so that they rotate or pivot through the same angle during the operation of the web guide. Both of the cam levers 61 and 62 are provided with an upstanding arm formed with identical cam grooves 66 into which a cylindrical projection 67 of an adjacent pivot shaft 68 extends. The cam grooves 66 determine the vertical positions of the adjacent end of the idler roll 13, while their lateral position is established by parallel, opposed guide bearings 69 mounted on the frame 10. Therefore, the idler roll 13 can be raised and lowered with respect to the idler roll 11, but is maintained in a position of vertical alignment with the idler roll 11 so that the axes 12 and 14 remain parallel and along the vertical plane 58.

The cam lever 61 is provided with a rearwardly extending arm 71 having a longitudinally extending opening 72 therein. A cylindrical pin 73 carried by the adjacent connecting rod 23 extends into the opening 72. This provides a connection so that when the connecting rod 23 is raised, the cam lever 61 is pivoted in a clockwise direction around its pivot axis 63. Conversely, when the connecting rod 23 is lowered, the cam lever 61 rotates in an anticlockwise direction around its pivot axis 63. Because the two cam levers 61 and 62 are connected for co-rotation by the torque tube 64, such pivotal movement of the cam lever 61 caused by vertical movement of the connecting rod 23 causes identical pivotal movement of the cam lever 62.

The operation of the cam levers 61 and 62 ensures that the length of the path of the web through the web guide remains constant even when the air bars 16 and 17 are pivoted or angled with respect to the idler rolls 11 and 13.

When the two air bars are positioned so that their axes 18 and 19 are parallel to the axes 12 and 14 of the idler rolls, no lateral adjustment of the position of the web occurs, and the web enters and leaves the web guide without any difference between the lateral position of the web entering the web guide and the web leaving the web guide. An edge sensor 76 (schematically illustrated in FIG. 2), located to determine the position of the adjacent edge of the web extending along the reach 54, establishes the amount and direction of adjustment required to properly position the web as it leaves the web guide. When the edge sensor 76 determines that an adjustment of the lateral position of the web leaving the web guide is required, a signal is produced which causes the piston rod 42 to extend or retract to cause pivotal movement of the two air guides 16 and 17 with respect to the idler rolls 11 and 12. This causes the web to pass around the two air bars at a helix angle determined by the angle of the air bars 16 and 17 with respect to the idler rolls. Further, this causes the web to pass along the reach 52 at such helix angle with respect to the direction of web movement along the two reaches 49 and 54. This produces a lateral adjustment of the web, leaving the air bar 16 and moving along the reach 54 with respect to the position of the web entering the web guide. The amount of lateral adjustment of the web as it passes from the reach 49 to the reach 54 is determined by the angle of the two air bars 16 and 17 with respect to the idler rolls 11 and 13. As the web exits the upper air bar 16, it moves along the reach 54 in a direction parallel to the direction of movement of the web extending along the reach 49 and engages the idler roll 11 in a direction perpendicular to the area of engagement. Therefore, the web passes smoothly around the idler roll 11 and is not distorted during movement through the web guide.

Because the air bars provide a frictionless support for the web passing therearound, the web can freely move around the two air bars along helix angles to provide the adjustment. However, the web rolls around the two idler rolls with frictional contact and, therefore, enters and leaves the contact with the two idler rolls perpendicular to the direction of the axis thereof.

Because the path around the two air bars 16 and 17, and along the reach 53, is angulated when lateral adjustment is being performed, the path of the web passing around these two airs bars and along the reach 52 is increased by an amount which is a function of the angulation of the two air bars and, in turn, the amount of lateral adjustment being produced. In order to compensate for this increased length of a portion of the web path, the cams 66 are shaped to cause lowering of the idler roll 13 to shorten the length of the reaches 47 and 49 an amount equal to the increase in the length of the path caused by lateral adjustment.

Figure 6:
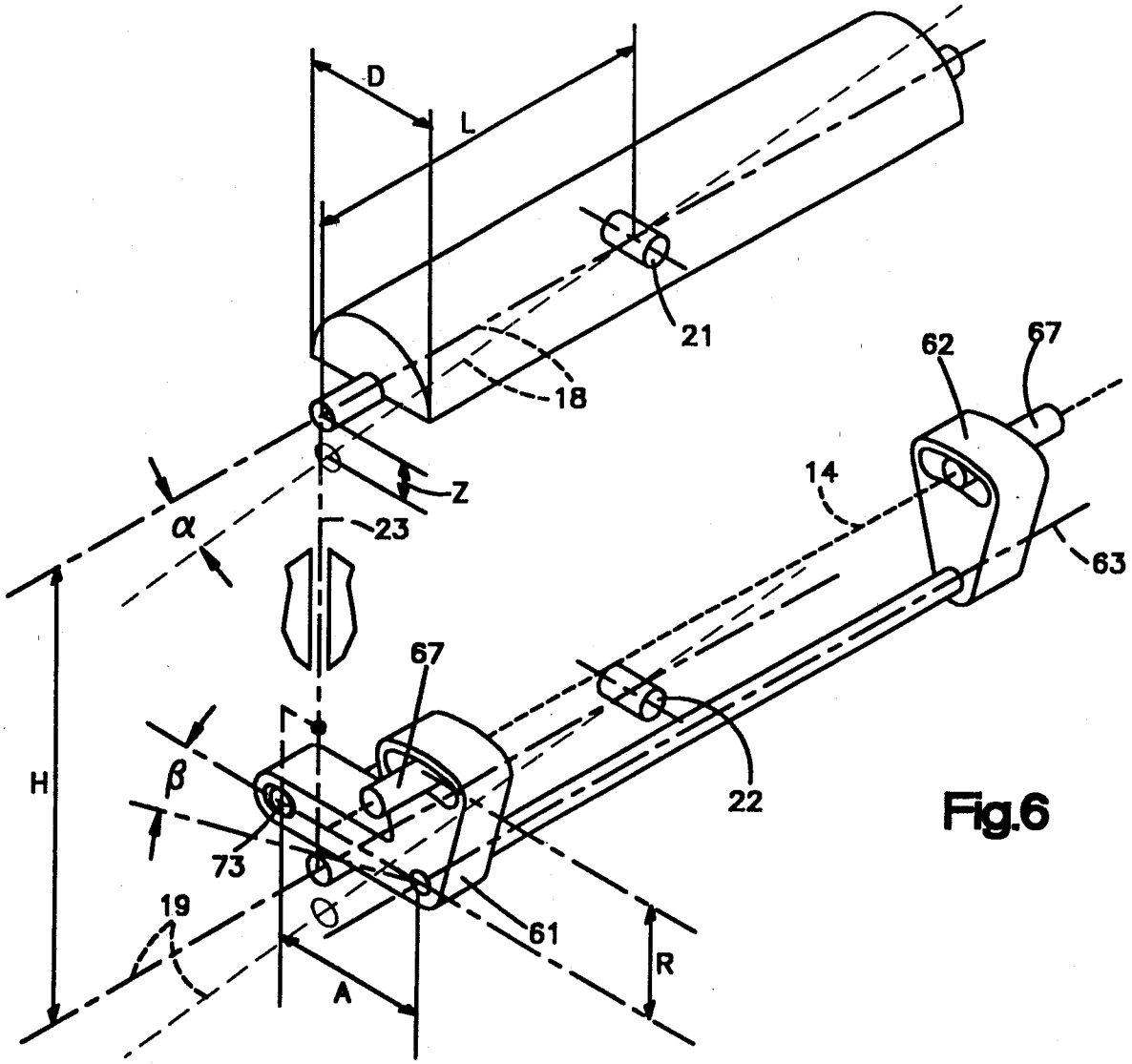
FIG. 6 is a schematic perspective view of the apparatus.

FIG. 6 is a schematic and diagrammatic illustration of the mechanical geometry of the web guide. The upper air bar is mounted so that its axis 18 can pivot about a support pivot 21 and the lower air bar is mounted so that its axis 19 can pivot about its pivot 22. The two connecting rods 23 and 24 are restrained and can only move vertically. Therefore, the horizontal distance from the pivot 21 to the connecting rod 23 remains constant and is the distance L in the following formula. When the two air bars are pivoted about their respective axes, they pivot to an angle alpha ($\alpha$) determined by the distance through which the connecting rod 23 moves either up or down from the neutral position. In the neutral position, the axes 18 and 19 are parallel to the axes 12 and 14 of the idler rollers. If, for example, the connecting rod 23 moves down from the neutral position through a distance Z, the angle alpha is determined by the formula:

$$\alpha = \mathrm{Tan}^{-1}\frac{Z}{L}$$

Such vertical movement of the connecting rod produces rotation of the two cam levers 61 and 62 about their pivot axis 63.

Again, since the connecting rod 23 is restrained to vertical movement, the horizontal distance between the axis of the pin 73 connecting the connecting rod and the lever arm 71 and the pivot axis 63 remains constant. That distance is represented by the distance A. The angle $\beta$ through which the cam levers 61 and 62 rotate around the axis 63 is determined by the formula:

$$\beta = \mathrm{Tan}^{-1}\frac{Z}{A}$$

where Z equals the amount of vertical movement of the connecting rod and A is equal to the horizontal distance between the pivot axis 63 and the axis of the pin 73.

With this structure, the change in path length, when lateral adjustment is being performed by movement of the two air bars from their neutral positions (designated $\Delta P$) is given by the formula:

$$\Delta P = \pi D\left(\frac{1}{\cos\alpha} - 1\right) + H\left(\frac{1}{\cos 2\alpha} - 1\right)$$

where D is equal to the diameter of the two air bars, including the thickness of the layer of air, and H is equal to the vertical spacing between the two axes 18 and 19.

Since the lowering of the idler roll 13 by the operation of the cams shortens the two reaches 47 and 49, the change in the position of the axis 14 of the idler roll 13, designated ΔR, is given by the following formula:

$$\Delta R = \frac{\pi D\left(\frac{1}{\cos\alpha} - 1\right) + H\left(\frac{1}{\cos 2\alpha} - 1\right)}{2}$$

Since the angular movement of the cams is a function of the angle alpha, it is possible, by the use of this formula, to establish a cam profile in which the lower idler roll is lowered an amount which produces an exact compensation for the increased web path caused by the lateral adjustment of the web. Therefore, the length of the web path is maintained constant regardless of the amount of lateral adjustment being provided by the web guide. Consequently, the operation of the web guide does not change the tension in the web passing therethrough and there is no change in the tension of the web across the width thereof. Further, because the first reach 47 is parallel to the second reach 49, the wrap angle 48 of the web around the lower idler roll does not change as such lower idler roll moves up and down to maintain a constant web path length. In the instance of the upper idler roll 11, however, it is not necessary that the web moving toward the roll move along a plane which is parallel to the web leaving the roll, since the upper idler roll does not move during the operation of the web guide, and therefore the wrap angle 56 remains constant.

It should be understood that although the illustrated embodiment is described in connection with a web path in which the web enters around the lead-in roll and exits the machine from the upper idler roll 11, the machine operates with equal efficiency if the direction of web movement is reversed. Further, as mentioned previously, the machine can be positioned in other orientations, and it is not necessary that the corresponding idler rolls and air bars be positioned in vertical alignment.

With the present invention, a very compact unit is provided which does not require substantial floor space and which is capable of substantial lateral adjustment of the web without changing the tension of the web during the adjusting operations.

Although the preferred embodiment of this invention has been shown and described, it should be understood that various modifications and rearrangements of the parts may be resorted to without departing from the scope of the invention as disclosed and claimed herein.

What is claimed is:

1. A web guide machine for a running web comprising a pair of spaced and parallel rolls, a pair of spaced and parallel air bar guides, said rolls and bars guiding said web along a path through said machine from a web entrance to a web exit, said air bars being movable from a position parallel to said rolls to angulated positions and operating to maintain a constant position of said web at said web exit when the position of said web at said web entrance varies, and a cam lever movable in response to an angulated movement of said air bars operating to change the spacing between said rolls and maintain a constant length of said path.

2. A machine as set forth in claim 1, wherein said change in spacing between said rolls caused by said cam lever is determined by the formula:

$$\Delta R = \frac{\pi D\left(\frac{1}{\cos\alpha} - 1\right) + H\left(\frac{1}{\cos 2\alpha} - 1\right)}{2}$$

wherein

D equals the diameter of the air bars including the thickness of the layer of air;

H equals the vertical spacing between the axes of the air bars; and, $\alpha$ is the angle of movement of the air bars from a neutral position in which the axes of the air bars are parallel to the axes of the rolls.

3. An air bar web guide for adjusting the lateral position of a web moving to a processing station, comprising a roll unit including first and second rolls respectively journaled for rotation about parallel first and second axes, an air bar guide unit including first and second opposed air bar guides each operable to guide a web along a path around third and fourth axes, said rolls and bars being positioned so that a web moving along a path through said web guide passes along:

(a) a first reach between said first roll and said first air bar guide;

(b) a second reach from said first air bar guide to said second air bar guide; and (c) a third reach from said second air bar guide to said second roll;

all of said reaches extending along mutually parallel planes, said air bar guide units being mounted for relative angular movement with respect to the roll unit while maintaining said first and second axes parallel to each other and said third and fourth axes parallel to each other, said air bar guide and roll units causing said web to move along said reaches without lateral displacement when all of said axes are parallel, said relative angular movement between said air bar guide units causing said second reach to angle laterally relative to said first and third reaches while said first and third reaches remain parallel causing lateral position adjustment of said web passing along said first and third reaches without changing the length of said path of said web along one edge thereof relative to the length of said path of said web along the other edge thereof, and cam means responsive to the relative angular position of said air bar guide units to adjust the spacing between associated axes to maintain a constant predetermined total length of said path of said web through said web guide.

4. A web guide as set forth in claim 3, wherein said cam means operate to change the spacing between said first and second axes.

5. A web guide as set forth in claim 4, wherein said cam means includes a cam shaped to move one of said rolls toward and away from the other of said rolls.

6. A web guide as set forth in claim 5, wherein said cam means operates without changing the wrap angle of said web around said one of said rolls.

7. A web guide as set forth in claim 5, wherein said air bar unit is movable to provide said relative angular movement, and said cam means includes a linkage operable to move said cam in response to angular movement of said air bar unit.

8. A web guide machine comprising a roll unit and an air bar unit, both of said units having components operable to guide a moving web along a path through said machine, a first of said units being moveable to an angulated position relative to the second of said units to maintain a constant lateral position of said web as said web exits from said machine, and cam means operable in response to movement to said angulated positions to adjust the spacing between said components of said second of said units and maintain a constant length of said path, said web passing around and between said components of said air bar unit at an angle when said units are angulated causing an increased length of a portion of said path, said cam means reducing the length of other portions of said path to maintain said constant length of said path, said cam means including a cam lever mounted for movement around a pivot and positioned by a linkage, said linkage producing oscillation of said cam lever through angles which are a function of the angulation between said units, said cam lever being connected to said second of said units to adjust the spacing of the components thereof in response to the oscillation of said cam lever through said angles.

* * * * *